US006301555B2

(12) United States Patent
Hinderks

(10) Patent No.: US 6,301,555 B2
(45) **Date of Patent: *Oct. 9, 2001**

(54) ADJUSTABLE PSYCHO-ACOUSTIC PARAMETERS

(75) Inventor: Larry W. Hinderks, Holmdel, NJ (US)

(73) Assignee: Corporate Computer Systems, Holmdel, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/047,823

(22) Filed: Mar. 25, 1998

Related U.S. Application Data

(63) Continuation of application No. 08/420,721, filed on Apr. 10, 1995, now abandoned.

(51) Int. Cl.[7] ..... G10L 19/00; G10L 19/14
(52) U.S. Cl. ..... 704/200.1
(58) Field of Search ..... 704/226–230, 704/205, 206, 500, 501, 503, 504, 200.1

(56) References Cited

U.S. PATENT DOCUMENTS

| | | | | |
|---|---|---|---|---|
| 4,130,730 | | 12/1978 | Ostrowski | 704/264 |
| 4,346,262 | | 8/1982 | Willems et al. | 704/217 |
| 4,624,012 | | 11/1986 | Lin et al. | 704/261 |
| 4,641,343 | | 2/1987 | Holland et al. | 704/276 |
| 4,972,484 | | 11/1990 | Theile et al. | 704/227 |
| 5,151,998 | | 9/1992 | Capps | 704/278 |
| 5,214,708 | | 5/1993 | McEachern | 704/266 |
| 5,301,363 | | 4/1994 | Hinderks | 455/101 |
| 5,341,457 | * | 8/1994 | Hall, II et al. | 704/226 |
| 5,388,182 | | 2/1995 | Benedetto et al. | 704/205 |
| 5,463,424 | * | 10/1995 | Dressler | 704/501 |
| 5,490,233 | | 2/1996 | Kovacevic | 704/230 |
| 5,495,554 | | 2/1996 | Edwards et al. | 704/205 |
| 5,528,725 | | 6/1996 | Hui | 704/236 |
| 5,535,300 | * | 7/1996 | Hall, II et al. | 704/227 |
| 5,581,653 | * | 12/1996 | Todd | 704/229 |
| 5,583,962 | * | 12/1996 | Davis et al. | 704/229 |
| 5,590,108 | * | 12/1996 | Mitsuno et al. | 704/229 |
| 5,633,981 | * | 5/1997 | Davis | 704/230 |
| 5,706,335 | * | 1/1998 | Hinderks | 379/399 |
| 6,041,295 | * | 3/2000 | Hinderks | 704/206 |

OTHER PUBLICATIONS

"ISO–MPEG–1 Audio: A Generic Standard for Coding of High–Quality Digital Audio" Kartheinz Bradenburg and Gerhard Stoll, Journal of Audio Eng. Soc., vol. 42, No. 10, pp. 780–792, (Oct., 1994).

* cited by examiner

*Primary Examiner*—David D. Knepper
(74) *Attorney, Agent, or Firm*—Nath & Associates PLLC; Robert C. Ryan

(57) ABSTRACT

An audio digital CODEC is provided with various parameters that when changed affect the quality of the resultant audio. These psycho-acoustic parameters include the standard ISO parameters and additional parameters to aid in effecting a pure resulting audio quality. The psycho-acoustic parameters located in the audio digital CODEC can be monitored and controlled by the user. The parameters can be monitored by a speaker associated with the CODEC or headphones. The user can control the adjustment of the psycho-acoustic parameters through the use of knobs present on the front panel of the CODEC or graphic or digital representations. Adjustment of the parameters will provide real time change of the resulting audio sound that the user can monitor through the speaker or the headphones. Dynamic Psycho-acoustic Parameter Adjustment permits the user to dynamically chance the values of different parameters. The ability to chance the parameters can be embodied in front panel knobs or in the action of computer software as instructed by the user.

36 Claims, 3 Drawing Sheets

ADJUSTABLE PSYCHO-ACOUSTIC PARAMETERS

This is a continuation of application Ser. No. 08/420,721 filed Apr. 10, 1995, now abandoned, the contents of which are incorporate herein by reference in their entirety.

FIELD OF THE INVENTION

The present invention relates generally to an audio CODEC for the compression and decompression of audio input signals for transmission over digital facilities, and more specifically, relates to an audio CODEC and method to allow a user to program a number of psycho-acoustic parameters for varying the compression and decompression of digital bit streams and to adjust the resultant audio output.

BACKGROUND OF THE INVENTION

Current technology permits the translation of analog audio signals into a sequence of binary numbers. These numbers can then be transmitted through a variety of different transmission facilities and then can be converted back into analog audio signals. The device for performing both the conversion from analog to binary and the conversion from binary back to analog is called a CODEC. This is an acronym for Coder/DECoder.

The cost of transmitting bits from one location to another is a function of the number of bits transmitted per second. The higher the bit transfer rate the higher the cost, Certain laws of physics and psychoacoustics describe a direct relationship between perceived audio quality and the number of bits transferred per second. The net result is that improved audio quality increases the cost of transmission. CODEC manufacturers have developed technologies to reduce the number of bits required to transmit any given audio signal (compression techniques) thereby reducing the associated transmission costs. The cost of transmitting bits is also a function of the transmission facility used, i.e. satellite, PCM phone lines, ISDN, ATM.

A CODEC that utilizes some of these compression techniques also acts as a computing device. The CODEC inputs the analog audio, converts the audio to digital bit streams, and then applies a compression technique to the bits thereby reducing the number of bits required to successfully transmit the original audio signal. The receiving CODEC applies the same compression techniques in reverse (decompression) so that it is able to convert the compressed bit stream back into analog audio output. The difference in quality between the analog audio input and the reconstituted audio output is a measure of the quality of the effectiveness of the compression techniques utilized. The highest quality technique would yield an identical signal reconstruction.

Currently, the most successful audio compression techniques for general audio sounds (as opposed to human speech sounds) are called perceptual coding techniques. These types of compression techniques attempt to model the human ear. These compression techniques are based on the recognition that much of what is given to the human ear is discarded (masked) because of the characteristics of the human hearing process. For example, if a loud sound is presented to a human ear along with a softer sound, the ear will hear only the louder sound. Whether the human ear will hear both the loud and soft sounds depends on the frequency of each of the signals. As a result, encoding compression techniques can effectively ignore the softer sound and not assign any bits to its transmission and reproduction under the assumption that a human listener can not hear the softer sound even if it is faithfully transmitted and reproduced.

All perceptual coding techniques have certain parameters that determine their behavior. For example, the coding technique must determine how soft a sound should be relative to a louder sound in order to determine whether the softer sound would be masked and could then be excluded from transmission. A number that determines this masking threshold is considered a parameter in the compression technique. These parameters are largely based on the human psychology of perception, so they are collectively known as psycho-acoustic parameters.

In order to ensure interoperability of CODECs from different manufacturers and to ensure an overall level of audio quality, standard coding techniques have been developed. One such technique is the so-called ISO/MPEG Layer-II compression standard. This technique or standard is a process for the compression and decompression of an audio input. This standard dictates a bit stream syntax for the transmission of the binary data after it is compressed and for the compression technique itself. Further, the standard includes a collection of psycho-acoustic parameters that is useful in performing the compression. U.S. Pat. No. 4,972,484, entitled "Method of Transmitting or Storing Masked Sub-band Coded Audio Signals," discloses the ISO/MPEG Layer II technique operable in the CODECs of different manufacturers.

Current standards, however, do not require any specific parameter set. The manufacturers of CODECs determine a set of psycho-acoustic parameters either from the standard or as modified by the manufacturer in an attempt to provide the highest quality sound with the lowest number of bits. Once a given parameter set is determined, the manufacturer selects what is perceived as the best value for each of the parameters, and that set of values determines the resultant quality of the CODEC's audio output. Presumably, a given manufacturer will choose a parameter set to provide what it perceives as the best resultant quality. In currently available CODECs, users typically are unaware of the existence or nature of these parameters. The user has no control over the actual parameters even though they directly affect the quality of the audio output. As a result, the users must test different CODECs from different manufacturers and then select the one device that meets requirements or sounds best to the particular user.

Although no set parameters are required, ten (10) standard parameters are typically included in prior art CODECs. These prior art CODECs have implemented these 10 standard parameters because they have been accepted by the ISO and have been adopted as part of the ISO/MPEG Layer-H compression standard. This standard and its utilization of the 10 parameters does not utilize or provide CD quality output that the user desires.

The applicant has discovered that this is a problem because the value for each standard parameter is determined based on the average human ear. The parameters do not take into account the variations between each individual's hearing capabilities. The applicant has recognized that in existing CODECs, no method or apparatus is available for users to tune their CODECs to address these subjective criteria and meet changing audio needs and to shape the overall sound of their application. Accordingly, a user must test different CODECs from different manufacturers and then select the one device that has the features or options they desire. The applicant has also discovered that the inclusion of other parameters can provide closer to CD quality sound than a CODEC that includes only the 10 standard parameters. Applicant has also discovered that adjustment of these additional parameters can further improve the quality of the resultant audio output.

OBJECTS OF THE INVENTION

The disclosed invention has various embodiments that achieve one or more of the following features or objects:

It is an object of the present invention to provide a programmable audio CODEC with a plurality of psycho-acoustic parameters that can be monitored, controlled, and adjusted by a user to change the audio output from the CODEC.

It is a related object of the present invention to provide an audio CODEC including more psycho-acoustic parameters than are utilized in prior art systems.

It is a further related object of the present invention to provide an audio CODEC where the psycho-acoustic parameters are changed by knobs on the front panel of the CODEC.

It is another related object of the present invention to provide an audio CODEC where the psycho-acoustic parameters are changed by a keypad on the front panel of the CODEC.

It is still a further related object of the present invention to provide an audio CODEC with a personal computer connected thereto to adjust the psycho-acoustic parameters by changing graphic representations of the parameters on a computer screen.

It is yet a further related object of the present invention to allow a user to monitor the audio output from the CODEC.

It is yet another related object of the present invention to accommodate headphones by which a user can monitor the audio output from the CODEC.

It is another object of the present invention to provide a flexible audio CODEC with an encoder that is compatible with various decoders allowing for changes in the encoder which will not effect the encoder.

It is still another object of the present invention to provide an audio CODEC that allows a user to adjust the psycho-acoustic parameters and monitor the change in the output in real time.

It is still a further object of the present invention to provide digital audio compression techniques that yield improved and preferably CD quality audio.

It is a related object of the present invention to provide a compression scheme that yields better audio quality than the MPEG compression standard.

It is still another related object of the present invention to provide CD quality audio that achieves a 12 to 1 compression ratio.

It is yet another related object of the present invention to provide audio output that is at worst virtually indistinguishable from CD quality sound.

It is yet another further object of the present invention to obtain a better understanding of psycho-acoustic processing of sound by the human mind.

SUMMARY OF THE INVENTION

The applicant's CODEC is flexible, programmable, and allows the user to have ultimate control over the resulting audio output. Unlike users of prior CODECs, users of the disclosed CODEC are aware of the existence of various psycho-acoustic parameters. These psycho-acoustic parameters include the ten standard ISO parameters that have been utilized by manufacturers previously as well as nineteen newly developed parameters that further enhance the quality of audio output from the disclosed CODEC.

The invention preferably provides apparatus, such as knobs or a keypad on the face of a CODEC, that allows a user of the CODEC to modify and control the value of the psycho-acoustic parameters and simultaneously observe the results of those parameter modifications in real time. By allowing a user to modify or adjust these parameters, the disclosed CODEC provides several advantages over prior CODECs, including allowing a user to recognize the existence of these psycho-acoustic parameters, change the parameters if the user desires, and evaluate the effect of these changes.

The disclosed CODEC preferably provides an RS232 port on the rear panel of the CODEC. This port allows insertion of a cable to mechanically and electrically connect a personal computer thereto. The personal computer has a monitor that allows a user to monitor and control the value of the psycho-acoustic parameters through the use of graphic or pictorial representations. The graphics or pictorials represent various psycho-acoustic parameters and the user can change the setting of each graphic or pictorial. By changing a graphic or pictorial, the user changes the value of the corresponding parameter. The user can then monitor the effect of the changed parameter on the resulting audio output in real time.

The applicant's most preferred CODEC includes at least 30 parameters. In this preferred embodiment, each parameter is one of four types. The four types are Db, Bark, floating point, and integer. Each parameter is assigned a default value. Preferably, the user can change the default value, as described above, and the new value will then be saved, preferably on a ROM in the CODEC.

The preferred CODEC can also include 20 different compressed digital and bit values and 6 sampling rates. This yields a total of 120 different psycho-acoustic parameter tables that the user can modify.

The applicant's preferred compression scheme achieves a 12 to 1 compression ratio. This compression ratio is better than the MPEG compression scheme. Applicant's compression scheme also produces CD quality sound or at least audio that is virtually indistinguishable from CD quality sound.

Additional features and advantages of the present invention will become apparent to one skilled in the art upon consideration of the following detailed description of the present invention.

BRIEF DESCRIPTIONS OF THE DRAWINGS

A preferred embodiment of the present invention is described by reference to the following drawings.

DETAILED DESCRIPTION OF THE PREFERRED EMBODIMENT

Figure 1:
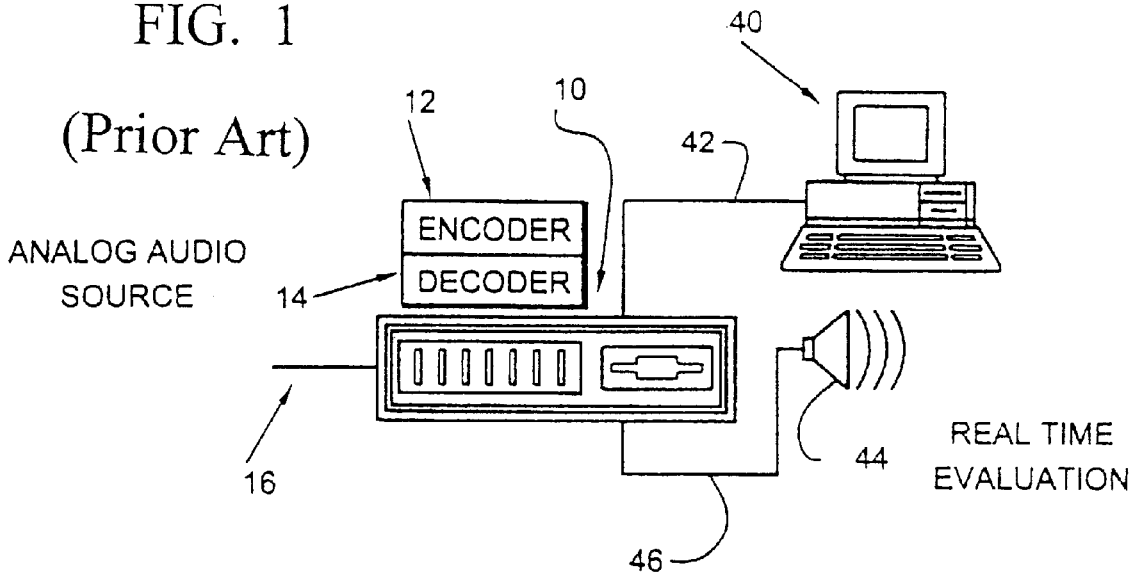
FIG. 1 (Prior Art)
FIG. 1 is a diagram illustrating the interconnection between various modules in accordance with a preferred embodiment.
Figure 2:
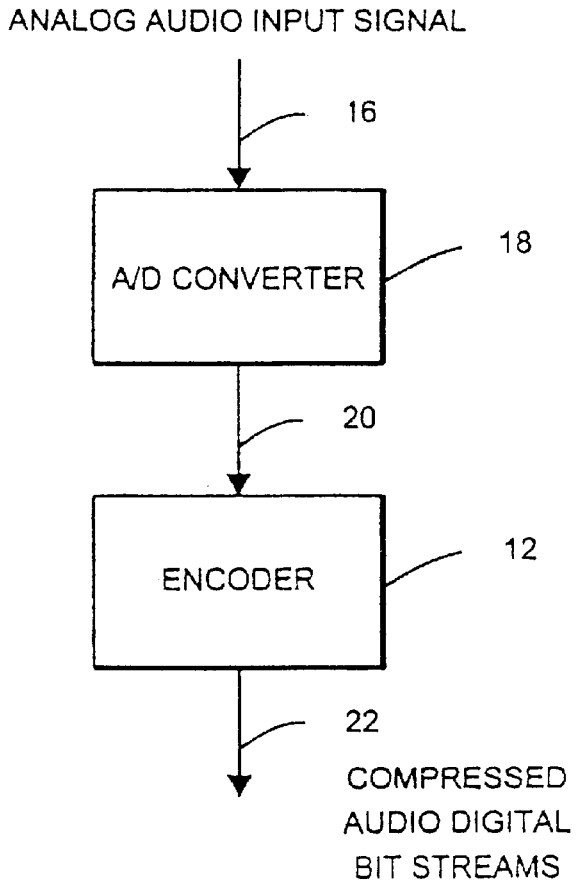
FIG. 2 (Prior Art)
FIG. 2 is a block diagram of an embodiment of an encoder as implemented in the CODEC of the system in accordance with the preferred embodiment shown in FIG. 1.

With reference to FIGS. 1 and 2, a CODEC 10 has an encoder 12 and a decoder 14. The encoder 12 receives as input an analog audio source 16. The analog audio source 16 is converted by an analog to digital converter 18 to a digital audio bit stream 20. The analog to digital converter 18 can be located before the encoder 12, but is preferably contained therein. In the encoder 12, compression techniques compress the digital audio bit stream 20 to filter out unnecessary and redundant noises. In the preferred embodiment, the compression technique is the MUSICAM® brand audio compression-decompression technique. The resultant compressed digital audio bit stream 22 is then transmitted by various transmission facilities (not shown) to a decoder at another CODEC (not shown). The decoder decompresses the digital audio bit stream and then the digital bit stream is converted to an analog signal.

The MUSICAM® compression technique utilized by the CODEC 10 to compress the digital audio bit stream 20 is attached as the Software Appendix to applicant's application entitled "System for Compression and Decompression of Audio Signals for Digital Transmission," which is being filed concurrently herewith (application Ser. No. 08/419,200, now abandoned, continued as application Ser. No. 08/630,790, now U.S. Pat. No. 6,041,295) (such application and Software Appendix are hereby incorporated by reference). The compression and decompression technique disclosed in the incorporated Software Appendix is an improvement of the psycho-acoustic model I that is described in the document entitled "Information Technology Generic Coding of Moving Pictures And Associated Audio," and is identified by citation ISO 3-11172 Rev. 2.

The audio compression model I referred to above is premised on the assumption that if two sounds—a loud sound and a soft sound—are transmitted to a human ear, the loud sound will often mask the soft sound. If the two sounds have very different frequencies, then the loud sound often will not mask the soft sound. The two sounds are identified by the compression model I technique. This model I also identifies the frequency of each sound as well as the power of each sound to determine if masking occurs. If masking does occur, then the model I compression technique will filter out the masked (redundant) sound.

The audio compression model I is also premised on the assumption that there are two kinds of sound maskers. These two types of sound maskers are known as tonal and noise maskers. A tonal masker will arise from audio signals that generate nearly pure, harmonically rich tones or signals. A tonal masker that is pure (extremely clear) will have a narrow bandwidth. On the other hand, a noise masker will arise from signals that are not pure. Because noise maskers are not pure, they have a wider bandwidth and appear in many frequencies and will mask more than the tonal masker.

Figure 3:
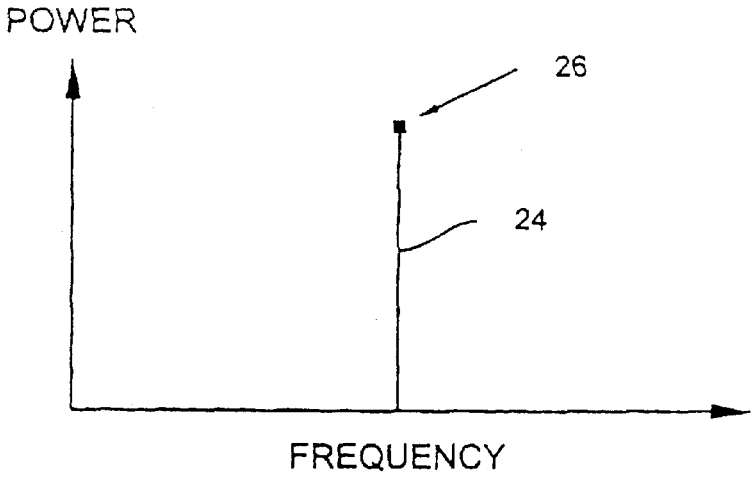
FIG. 3 is a diagram illustrating a known representation of a tonal masker as received and recognized by a CODEC system.

FIG. 3 is a representation of a tonal masker 24. The tonal masker 24 is represented by a single vertical line and is almost entirely pure. Because the tonal masker 24 is almost pure, the frequency remains constant as the power increases. The peak power of the tonal masker 24 is represented by the number 26. The peak power is the maximum value of the masker 24. The frequency resolution in the MUSICAM® psycho-acoustic model at a 48 KHZ sampling rate is 48,000/1024 HZ wide or about 46 HZ. The line in FIG. 3 shows a tonal masker with 46 HZ of bandwidth, and sound within that bandwidth, but below the peak power level 26 are "masked" because of the minimum frequency resolving power of the model I technique. An instrument that produces many harmonics, such as a violin or a trumpet, may have many such tonal maskers. The method of how to identify a tonal masker from a noise masker is described in the ISO specification and the patent referenced above.

Figure 4:
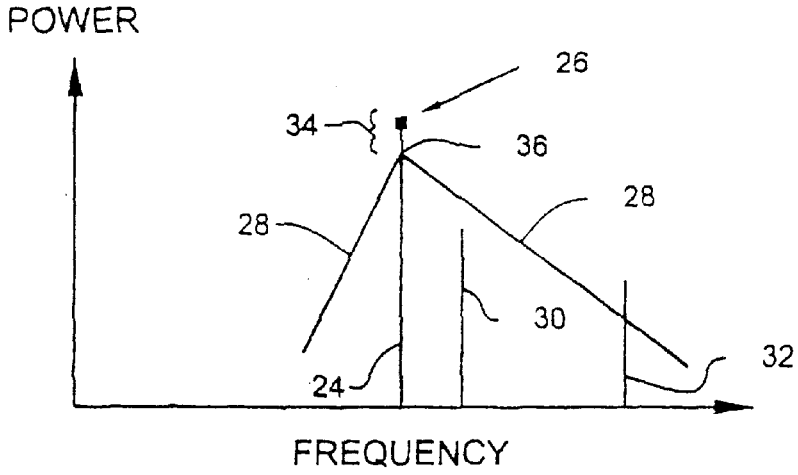
FIG. 4 is a diagram illustrating a known representation of a tonal masker and its associated masking skirts as recognized by a CODEC system.

FIG. 4 shows a tonal masker 24 with its associated masking skirts 28. The masking skirts 28 indicate which signals will be masked. A signal that falls below the masking skirt (such as the signal designated 30) cannot be heard because it falls below the masking skirt 28 and is masked. On the other hand, a smaller amplitude tone (such as 32) can be heard because it falls above the masking skirt 28.

The exact shape of the masking skirt 28 is a function of various psycho-acoustic parameters. For example, the closer in frequency the signal is to the tonal masker 24, the more signals the masking skirt 28 will mask. Signals that have very different frequencies such as signal 32 are less likely to fall below the masking skirt 28 and be masked.

Figure 5:
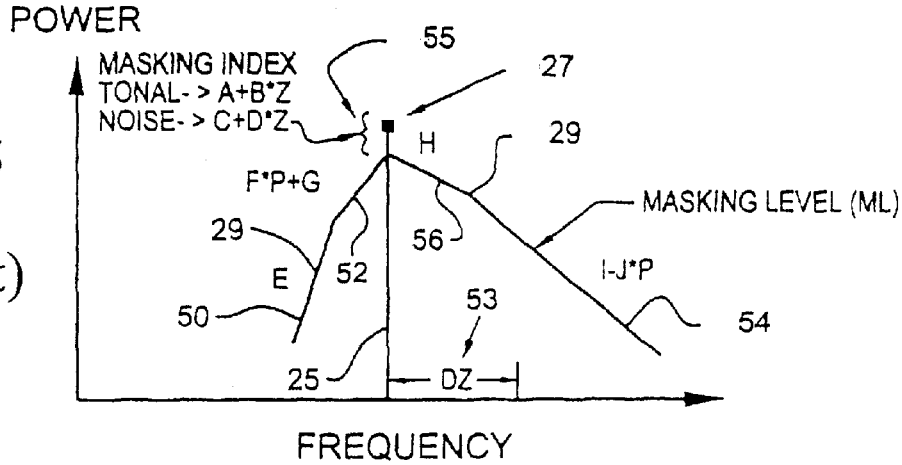
FIG. 5 (Prior Art)
FIG. 5 is a diagram illustrating a tonal masker and its associated masking skirts as implemented by the MUSICAM® system as implemented by the encoder of the system in accordance with the preferred embodiment shown in FIG. 1.

The tonal masker 24 also has a masking index 34. The value of the masking index is also a function of various psycho-acoustic parameters. The masking index 34 is the distance from the peak 26 of the tonal masker 24 to the top 36 of the masking skirt 28. This distance is measured in dB. This masking index 34 is also frequency dependent as shown in FIG. 5. The frequency in psycho-acoustics is often measured in Bark instead of Hertz. There is a simple function that relates Bark to Hertz. The frequency scale of 0 to 20,000 Hertz is represented by approximately 0 to 24 Bark. The Bark-Hertz mapping is highly non-linear. At low frequencies, the human ear/brain has the ability to discern small differences in the frequency of a signal if its frequency is changed. As the frequency of a signal is increased, the ability of the human ear to discern differences between two signals with different frequencies diminishes. At high frequencies, a signal must change by a large value before the human auditory system can discern the change. This non-linear frequency resolution ability of the human auditory system is well known.

Often, however, audio has no single dominant frequency (tonal) but is more "noise" like. In this case, a noise masker is constructed by summing all the energy within 1 Bark (a critical band) and forming a single "noise" masker at the center of the critical band. Since there are 24 Bark (critical bands) then there are 24 noise maskers. The noise maskers are treated just like the tonal maskers. This means that they have a masking index and a masking skirt. It is known that an audio signal may or may not have tonal maskers 24, but it will always have 24 noise maskers.

Turning to FIG. 5 which illustrates the actual masking skirt 28 as described in the ISO specification for psycho-acoustic model I. The various slopes of the masking skirt 28 depend on the level of the masker 24 as well as the distance DZ, indicated by the number 53, from the masker 24 to the signal being masked. The masking index, AV, indicated by the number 55, is a function of the frequency. These are well known characteristics that have been determined by readily available psycho-acoustic studies. A summary of such studies is contained in the book by Zweiker and Fastl entitled "Psychoacoustics". These studies have attempted to estimate the various slopes and masking indices, but their actual values can be adjusted by this invention to improve the quality of the compressed audio.

The compression models operate based on a set of psycho-acoustic parameters. These parameters are variables that are programmed into CODECs by manufacturers. The CODEC manufacturers set the values so as to affect the resultant quality of the audio output to fit their desires.

The disclosed CODEC 10 utilizes the same psycho-acoustical model as described in the ISO psycho-acoustical model I as the basis for its parameters. The ISO model I has set standard values for ten model parameters (A, B . . . J). These model parameters are described below:

From ISO Spec.

A=6.025 dB

B=0.275 dB/Bark

C=2.025 dB

D=0.175 dB/Bark

E=17.0 dB/Bark

F=0.4 1/Bark

G=6.0 dB/Bark

H=17.0 dB/Bark

I=17.0 dB/Bark

J=0.15 1/Bark

Parameters A through J are determined as follows:

Z=freq in Bark

DZ=distance in Bark from master peak (may be + or −) as shown in FIGURES

Pxx(Z(k))=Power in SPL(96 db=+/−32767) at frequency Z of masker K xx=tm for tonal masker or nm for noise masker Pxx is adjusted so that a full scale sine wave (+/−32767) generates a Pxx of 96 db.

Pxx=XFFT+96.0 where XFFT=0 db at +/−32767 amplitude

XFFT is the raw output of an FFT. It must be scaled to convert it to Pxx

AVtm(k)=A+B*Z(k) Masking index for tonal masker k

AVnm(k)=C+D*Z(k) Masking index for tonal masker k

VF(k,DZ)=E*(|DZ|−1)+(F*X(Z(k))+G)

VF(k,DZ)=(F*X(Z(k))+G)*|DZ|

VF(k,DZ)=H*DZ

VF(k,DZ)=(DZ−1)*(I−J*X(Z(k)))+H

MLxx(k,DZ)=Pxx(k)−(AVxx(K)+VF(k,DZ))

MLxx is the masking level generated by each masker k at a distance DZ from the masker.

where xx=tm or nm

Pxx=Power for tm or nm

Parameters A through J are shown in FIG. 5. Parameters A through J are fully described in the ISO 11172-3 document, and are well known to those of ordinary skill in the art. With reference to FIG. 5, the slope of the bottom portion 50 of the left masking skirt 28 is representative of parameter E. The top portion 52 of the left masking skirt 28 is illustrative of a parameter defined by F*P+G. The bottom portion 54 of the right masking skirt 28 is representative of a parameter defined by I−J*P. The top portion 56 of the right masking skirt 28 is representative parameter H. The masking index 34 for a tonal masker 24 is representative of a parameter defined by AV(tonal)=A+B*Z, and the masking index 34 for a noise masker is representative of a parameter defined by AV(noise)=C+D*Z.

It has been determined that the adjustment of additional parameters can enhance the resulting audio output from the CODEC. The disclosed CODEC allows for tuning of these additional parameters. These additional parameters are defined as follows:

Parameter K—Joint Stereo Sub-band Minimum Value

This parameter ranges from 1 to 31 and represents the minimum sub-band at which the joint stereo is permitted. The ISO specification allows joint stereo to begin at sub-band 4, 8, 12, or 16. Setting K to 5 would set the minimum to 8. Setting this parameter to 1 would set the minimum sub-band for joint stereo to 4.

Parameter L—Anti-correlation Joint Stereo Factor

This parameter attempts to determine if there is a sub-band in which the left and right channels have high levels, but when summed together to form mono, the resulting mono mix has very low levels. This occurs when the left and right signals are anti-correlated. If anti-correlation occurs in a sub-band, joint stereo which includes that sub-band cannot be used. In this case, the joint stereo boundary must be raised to a higher sub-band. This will result in greater quantization noise but without the annoyance of the anti-correlation artifact. A low value of L indicates that if there is a very slight amount of anti-correlation, then move the sub-band boundary for joint stereo to a higher value.

Parameter M—Limit Sub-bands

This parameter can range from 0 to 31 in steps of 1. It represents the minimum number of sub-bands which receive at least the minimum number of bits. Setting this to 8.3 would insure that sub-bands 0 through 7 would receive the minimum number of bits independent of the psychoacoustic model. It has been found that the psychoacoustic model sometimes determines that no bits are required for a sub-band and using no bits as the model specifies, results in annoying artifacts. This is because the next frame might require bits in the sub-band. This switching effect is very noticeable and annoying. See parameter { for another approach to solving the sub-band switching problem.

Parameter N—Demand/Constant Bit Rate

This is a binary parameter. If it is above 0.499 then the demand bit rate bit allocation mode is requested. If it is below 0.499 then the fixed rate bit allocation is requested. If the demand bit rate mode is requested, then the demand bit rate is output and can be read by the computer. Also, see parameter R. Operating the CODEC in the demand bit rate mode forces the bits to be allocated exactly as the model requires. The resulting bit rate may be more or less than the number of bits available. When demand bit rate is in effect, then parameter M has no meaning since all possible sub-bands are utilized and the required number of bits are allocated to use all of the sub-bands.

In the constant bit rate mode, the bits are allocated in such a manner that the specified bit rate is achieved. If the model requests less bits than are available, any extra bits are equally distributed to all sub-bands starting with the lower frequency sub-bands.

Parameter O—Safety Margin

This parameter ranges from −30 to +30 dB. It represents the safety margin added to the psychoacoustic model results. A positive safety margin means that more bits are used than the psychoacoustic model predicts, while a negative safety margin means to use less bits than the psychoacoustic model predicts. If the psychoacoustic model was exact, then this parameter would be set to 0.

Parameter P—Joint Stereo Scale Factor Mode

This parameter ranges from 0 to 0.999999. It is only used if joint stereo is required by the current frame. If joint stereo is not needed for the frame, then this parameter is not used. The parameter p is used in the following equation:

$$br = \text{demand bit rate} * p$$

If br is greater than the current bit rate ( . . . 128, 192, 256, 384), then the ISO method of selecting scale factors is used. The ISO method reduces temporal resolution and requires less bits. If br is less than the current bit rate, then a special method of choosing the scale factors is invoked. This special model generally requires that more bits are used for the scale factors but it provides a better stereo image and temporal resolution. This is generally better at bit rates of 192 and higher. Setting p to 0 always forces the ISO scale factor selection while setting p to 0.9999999 always forces the special joint stereo scale factor selection.

Parameter Q—Joint Stereo Boundary Adjustment

This parameter ranges from −7 to 7 and represents an adjustment to the sub-band where joint stereo starts. For example, if the psychoacoustic model chooses 14 for the start of the joint stereo and the Q parameter is set to −3, the joint boundary set to 11 (14−3). The joint bound must be 4, 8, 12 or 16 so the joint boundary is rounded to the closest value which is 12.

Parameter R—Demand Minimum Factor

This value ranges from 0 to 1 and represents the minimum that the demand bit rate is allowed to be. For example, if the demand bit rate mode of bit allocation is used and the demand bit rate is set to a maximum of 256 kbs and the R parameter is set to 0.75 then the minimum bit rate is 192 kbs (256*0.75). This parameter should not be necessary if the model was completely accurate. When tuning with the demand bit rate, this parameter should be set to 0.25 so that the minimum bit rate is a very low value.

Parameter S—stereo used sub-bands

This parameter ranges from 0 to 31 where 0 means use the default maximum (27 or 30) sub-bands as specified in the ISO specification when operating in the stereo and dual mono modes. If this parameter is set to 15, then only sub-bands 0 to 14 are allocated bits and sub-bands 15 and above have no bits allocated. Setting this parameter changes the frequency response of the CODEC. For example, if the sampling rate is 48,000 samples per second, then the sub-bands represent 750 HZ of bandwidth. If the used sub-bands is set to 20, then the frequency response of the CODEC would be from 20 to 15000 HZ (20*750).

Parameter T—Joint Frame Count

This parameter ranges from 0 to 24 and represents the minimum number of MUSICAM® frames (24 millisecond for 48 k or 36 ms for 32 k) that are coded using joint stereo. Setting this parameter non-zero keeps the model from switching quickly from joint stereo to dual mono. In the ISO model, there are 4 joint stereo boundaries. These are at sub-band 4, 8, 12 and 16 (starting at 0). If the psychoacoustic model requires that the boundary for joint stereo be set at 4 for the current frame and the next frame can be coded as a dual mono frame, then the T parameter requires that the boundary be kept at 4 for the next T frames, then the joint boundary is set to 8 for the next T frames and so on. This prevents the model from switching out of joint stereo so quickly. If the current frame is coded as dual mono and the next frame requires joint stereo coding, then the next frame is immediately switched into joint stereo. The T parameter has no effect for entering joint stereo, it only controls the exit from joint stereo. This parameter attempts to reduce annoying artifacts which arise from the switching in and out of the joint stereo mode.

Parameter U—Peak/rms Selection

This is a binary parameter. If the value is less than 0.499, then the psychoacoustic model utilizes the peak value of the samples within each sub-band to determine the number of bits to allocate for that sub-band. If the parameter is greater than 0.499, then the RMS value of all the samples in the sub-band is used to determine how many bits are needed in each sub-band. Generally, utilizing the RMS value results in a lower demand bit rate and higher audio quality.

Parameter V—Tonal Masker Addition

This parameter is a binary parameter. If it is below 0.499 the 3 db additional rule is used for tonals. If it is greater than 0.499, then the 6 db rule for tonals is used. The addition rule specifies how to add masking level for two adjacent tonal maskers. There is some psychoacoustic evidence that the masking of two adjacent tonal maskers is greater (6 db rule) than simply adding the sum of the power of each masking skirt (3 db). In other words, the masking is not the sum of the powers of each of the maskers. The masking ability of two closely spaced tonal maskers is greater than the sum of the power of each of the individual maskers at the specified frequency. See FIG. 6.

Parameter W—Sub-band 3 Adjustment

This parameter ranges from 0 to 15 db and represents an adjustment which is made to the psychoacoustic model for sub-band 3. It tells the psychoacoustic model to allocate more bits than calculated for this sub-band. A value of 7 would mean that 7 db more bits (remember that 1 bit equals 6 db) would be allocated to each sample in sub-band 3. This is used to compensate for inaccuracies in the psychoacoustic model at the frequency of sub-band 3 (3*750 to 4*750 Hz for 48 k sampling).

Parameter X—adj Sub-band 2 Adjustment

This parameter is identical to parameter W with the exception that the reference to sub-band 3 in the above-description for parameter W is changed to sub-band 2 for parameter X.

Parameter Y—adj Sub-band 1 Adjustment

This parameter is identical to parameter W with the exception that the reference to sub-band 3 in the above-description for parameter W is changed to sub-band 1 for parameter Y.

Parameter Z—adj Sub-band 0 Adjustment

This parameter is identical to parameter W with the exception that the reference to sub-band 3 in the above-description for parameter W is changed to sub-band 0 for parameter Z.

Parameter {—sb Hang Time

The psychoacoustic model may state that at the current time, a sub-band does not need any bits. The { parameter controls this condition. If the parameter is set to 10, then if the model calculates that no bits are needed for a certain sub-band, 10 consecutive frames must occur with no request for bits in that sub-band before no bits are allocated to the sub-band. There are 32 counters, one for each sub-band. The { parameter is the same for each sub-band. If a sub-band is turned off, and the next frame needs bits, the sub-band is immediately turned on. This parameter is used to prevent annoying switching on and off of sub-bands. Setting this parameter non-zero results in better sounding audio at higher bit rates but always requires more bits. Thus, at lower bit rates, the increased usage of bits may result in other artifacts.

Parameter |—Joint Stereo Scale Factor Adjustment

If this parameter is less than 0.49999, then scale factor adjustments are made. If this parameter is 0.5000 or greater, then no scale factor adjustments are made (this is the ISO mode). This parameter is used only if joint stereo is used. The scale factor adjustment considers the left and right scale factors a pair and tries to pick a scale factor pair so that the stereo image is better positioned in the left/right scale factor plane. The result of using scale factor adjustment is that the stereo image is significantly better in the joint stereo mode.

Parameter }—Mono Used Sub-bands

This parameter is identical to parameter S except it applies to mono audio frames.

Parameter '—Joint Stereo Used Sub-bands

This parameter is identical to parameter S except it applies to joint stereo audio frames.

As the psycho-acoustic parameters affect the resultant quality of the audio output, it would be advantageous for users to vary the output according to the user's desires.

In a preferred embodiment of the disclosed CODEC 10, the psycho-acoustic parameters can be adjusted by the user through a process called dynamic psycho-acoustic parameter adjustment (DPPA) or tuning. The software for executing DPPA is disclosed in the incorporated Software Appendix. DPPA offers at least three important advantages to a user of the disclosed CODEC over prior art CODECs. First, DPPA provides definitions of the controllable parameters and their effect on the resulting coding and compression processes. Second, the user has control over the settings of the defined DPPA parameters in real time. Third, the user can hear the result of experimental changes in the DPPA parameters. This feedback allows the user to intelligently choose between parameter alternatives.

Tuning the model parameters is best done when the demand bit rate is used. Demand bit rate is the bit rate calculated by the psycho-acoustic model. The demand bit rate is in contrast to a fixed bit rate. If a transmission facility is used to transmit compressed digital audio signals, then it will have a constant bit rate such as 64, 128, 192, 256 . . . kbs. When tuning the parameters while using the Parameter N described above, it is important that the demand bit rate is observed and monitored. The model parameters should be adjusted for the best sound with the minimum demand bit rate. Once the parameters have been optimized in the demand bit rate mode, they can be confirmed by running in the constant bit rate mode (see Parameter N).

DPPA also provides a way for the user to evaluate the effect of parameter changes. This is most typically embodied in the ability for the user to hear the output of the coding technique as changes are made to the psycho-acoustic parameters. The user can adjust a parameter and then listen to the resulting change in the audio quality. An alternate embodiment may incorporate measurement equipment in the CODEC so that the user would have an objective measurement of the effect of parameter adjustment on the resulting audio. Other advantages of the disclosed invention with the DPPA are that the user is aware of what effect the individual parameters have on the compression decompression scheme, is able to change the values of parameters, and is able to immediately assess the resulting effect of the current parameter set.

One advantage of the ability to change parameters in the disclosed CODEC, is that the changes can be accepted in real time. In other words, the user has the ability to change parameters while the audio is being processed by the system.

In the preferred embodiment, the MUSICAM® compression scheme (attached as the Software Appendix to the concurrently filed application as discussed above) thirty adjustable parameters are included. It is contemplated that additional parameters can be added to the CODEC to modify the audio output. Provisions have been made in the CODEC for these additional parameters.

Figure 6:
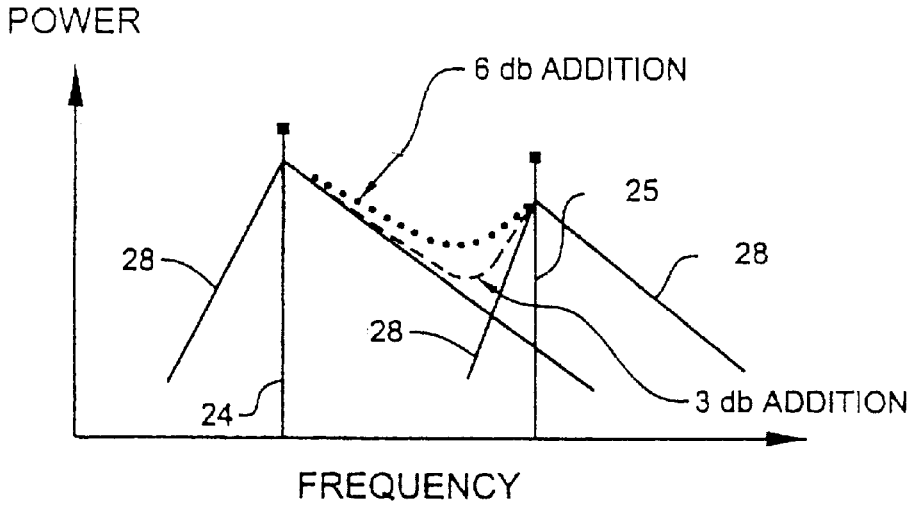
FIG. 6 is a diagram illustrating the representation of the addition of two tonal maskers as implemented by the encoder of the system in accordance with the preferred embodiment shown in FIG. 1.

Turning now to FIG. 6, one can see two tonal maskers 24 and 25. The individual masking skirts for these maskers are shown in 28. The question is how do these individual maskers mask a signal in the region in between 24 and 25. The summing of the masking effects of each of the individual maskers in unclear to the auditory researchers. MUSICAM® provides two methods of summing the effects of tonal maskers. These methods are controlled by Parameter V described above.

Figure 7:
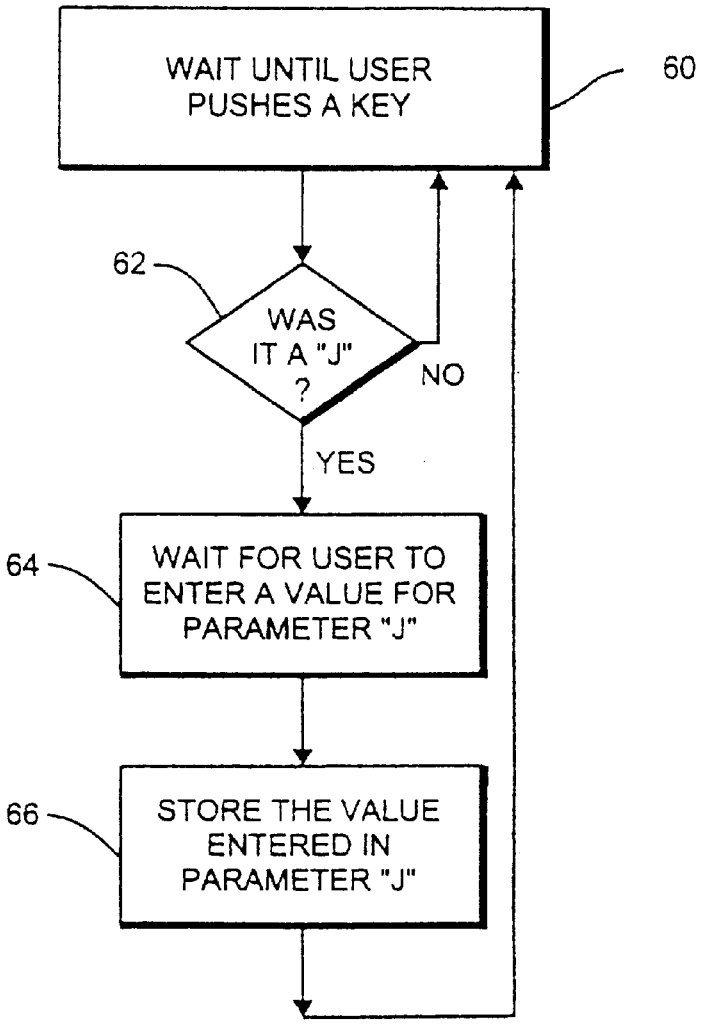
FIG. 7 is a block diagram illustrating the adjustment of a single parameter as performed by the encoder of the system in accordance with the preferred embodiment shown in FIG. 1.

FIG. 7 is illustrative of the steps the user must take to modify each parameter. As shown in FIG. 7, the parameters are set to their default value and remain at that value until the user turns one of the knobs, pushes one key on the keypad, or changes one of the graphics representative of one of the parameters on the computer monitor. Thus, as shown in box 60, the disclosed CODEC 10 waits until the user enters a command directed to one of the parameters. The CODEC 10 then determines which parameter had been adjusted. For example, in box 62 the CODEC inquires whether the parameter that was modified was parameter J. If parameter J was not selected, the CODEC 10 then returns to box 60 and awaits another command from the user. If parameter J was selected, the CODEC 10 awaits for the user to enter a value for that parameter in box 64. Once the user has entered a value for that parameter, the CODEC 10, in box 66, stores that new value for parameter J. The values for the default parameters are stored on a storage medium in the encoder 12, such as a ROM or other chip.

Turning again to FIGS. 1 and 2 (which generally illustrate the operation of the disclosed CODEC) an analog audio source 16 is fed into the encoder/decoder (CODEC) 10 which works in loop back mode (where the encoder directly feeds the decoder). Parametric adjustments can be made via a personal computer 40 attached to the CODEC 10 from an RS232 port (not shown) attached to the rear of the CODEC. A cable 42 which plugs into the RS232 port, connects into a spare port (not shown) on the PC 40 as shown in FIG. 1. The personal computer 40 is preferably an IBM-PC or IBM-PC clone, but can be an any personal computer including a Mackintosh®. The personal computer 40 should be at least a 386DX-33, but is preferably a 486. The PC should have a VGA monitor or the like. The preferred personal computer 40 should have at least 4 mb of memory, a serial com port, a mouse, and a hard drive.

Once the PC 40 is connected to the CODEC 10, a tuning file can be loaded onto the personal computer 40, and then the parameters can be sent to the encoder via a cable 42. A speaker 44 is preferably attached to the output of the CODEC 10, via a cable 46, to give the user real time output. As a result, the user can evaluate the results of the parameter adjustment. A headphone jack (not shown) is also preferably included so that a user can connect headphones to the CODEC and monitor the audio output.

The parameters can be adjusted and evaluated in a variety of different ways. In the preferred embodiment, a mouse is used to move a cursor to the parameter that the user wishes to adjust. The user then holds down the left mouse button and drags the fader button to the left or right to adjust the parameter while listening to the audio from the speaker 44. For example, if the user were to move the fader button for parameter J to the extreme right, the resulting audio would be degraded. With this knowledge of the system, parameter J can be moved to test the system to insure that the tuning program is communicating with the encoder. Once the user has changed all or some of the parameters, the newly adjusted parameters can be saved.

In another embodiment, control knobs or a keypad (not shown), can be located on the face of the CODEC 10 to allow the user to adjust the parameters. The knobs would communicate with the tuning program to effectuate the same result as with the fader buttons on the computer monitor. The attachment of the knobs can be hard with one knob allotted to each adjustable parameter, or it could be soft with a single knob shared between multiple parameters.

In another embodiment, a graphic representing an "n" dimensional space with the dimensions determined by the parameters could be shown on the computer display. The operator would move a pointer in that space. This would enable several parameters to be adjusted simultaneously. In still another embodiment, the parameters can be adjusted in groups. Often psycho-acoustic parameters only make sense when modified in groups with certain parameters having fixed relationships with other parameters. These groups of parameters are referred to as smart groups. Smart group adjustment would mean that logic in the CODEC would change related parameters (in the same group) when the user changes a given parameter. This would represent an acceptable surface in the adjustable parameter space.

In yet another embodiment, a digital parameter read out may be provided. This would allow the values of the parameters to be digitally displayed on either the CODEC 10 or the PC 40. The current state of the CODEC 10 can then be represented as a simple vector of numbers. This would enable the communication of parameter settings to other users.

Parameter adjustment can be evaluated in ways other than by listening to the output of speaker 44. In one embodiment, the CODEC 10 is provided with an integrated FFT analyzer and display, such as shown in applicant's invention entitled "System For Compression And Decompression Of Audio Signals For Digital Transmission," and the Software Appendix that is attached thereto, that are both hereby incorporated by reference. By attaching the FFT to the output of the CODEC, the user is able to observe the effect of parametric changes on frequency response. By attaching the FFT to the input of the CODEC, the user is able to observe frequency response input. The user can thus compare the input frequency response to the output frequency response. In another embodiment, the disclosed CODEC 10 is provided with test signals built into the system to illustrate the effect of different parameter adjustments.

In another embodiment, the DPPA system may be a "teaching unit." To determine the proper setting of each parameter, once the determination is made, then the teacher could be used to disburse the parameters to remote CODECs (receivers) connected to it. Using this embodiment, the data stream produced by the teaching unit is sent to the remote CODEC that would then use the data stream to synchronize their own parameters with those determined to be appropriate to the teacher. This entire system thus tracks a single lead CODEC and avoids the necessity of adjusting the parameters of all other CODECs in the network of CODECs.

This invention has been described above with reference to a preferred embodiment. Modifications and alterations may become apparent to one skilled in the art upon reading and understanding this specification. It is intended to include all such modifications and alterations within the scope of the appended claims.

What is claimed is:

1. An audio CODEC for providing high quality digital audio comprising:

an input for receiving an audio signal;

an encoder connected to said input, said encoder having a plurality of conventional ISO/MPEG layer-II psycho-acoustic parameters, and a plurality of additional joint-stereo psycho-acoustic parameters, said encoder encoding said audio signal into a compressed digital signal in accordance with said plurality of joint stereo psycho-acoustic parameters along with said conventional ISO/MPEG layer-II psycho-acoustic parameters, each of said joint-stereo psycho-acoustic parameters being selectively programably adjustable by a user for adjusting a compressing of said compressed digital signal; and a decoder for decompressing said compressed digital signal into a digital audio output.

2. The audio CODEC as claimed in claim 1 wherein at least two of said plurality of joint-stereo psycho-acoustic parameters further comprise a smart group whereby a change in a value of a first one of said at least two joint-stereo psycho-acoustic parameters in said smart group changes a corresponding value of a second one of said at least two joint-stereo psycho-acoustic parameters in said smart group.

3. The audio CODEC as claimed in claim 1 wherein at least one of said plurality of joint-stereo psycho-acoustic parameters has a default value.

4. The audio CODEC as claimed in claim 1 wherein said plurality of joint-stereo psycho-acoustic parameters further comprises a joint stereo sub-band minimum value parameter.

5. The audio CODEC as claimed in claim 4 wherein said joint stereo sub-band minimum value parameter has a value from 1 to 31.

6. The audio CODEC as claimed in claim 1 wherein said plurality of joint-stereo psycho-acoustic parameters further comprises an anti-correlation joint stereo factor parameter.

7. The audio CODEC as claimed in claim 1 wherein said plurality of joint-stereo psycho-acoustic parameters further comprises a joint stereo scale factor mode parameter.

8. The audio CODEC as claimed in claim 7 wherein said joint stereo scale factor mode parameter has a value from 0 to 0.999999.

9. The audio CODEC as claimed in claim 1 wherein said plurality of joint-stereo psycho-acoustic parameters further comprises a joint stereo boundary adjustment parameter.

10. The audio CODEC as claimed in claim 9 wherein said joint stereo boundary adjustment parameter has a value from −7 to +7.

11. The audio CODEC as claimed in claim 1 wherein said plurality of joint-stereo psycho-acoustic parameters further comprises a joint stereo scale factor adjustment parameter.

12. The audio CODEC as claimed in claim 1 wherein said plurality of joint-stereo psycho-acoustic parameters further comprises a joint stereo used parameter.

13. The audio CODEC as claimed in claim 12 wherein said joint stereo used parameter has a value from 0 to 31.

14. A method for providing high quality digital audio comprising the steps of:

providing an input audio signal;

providing a plurality of conventional ISO/MPEG layer-II psycho-acoustic parameters, and a plurality of additional joint-stereo psycho-acoustic parameters, each of said additional joint-stereo psycho-acoustic parameters being selectively programably adjustable by a user;

selectively adjusting one of said joint-stereo psycho-acoustic parameters;

compressing said audio signal into a compressed digital signal in accordance with said plurality of joint-stereo psycho-acoustic parameters along with said plurality of conventional ISO/MPEG layer-II psycho-acoustic parameters;

decompressing said compressed digital signal to provide an output audio signal.

15. The method of claim 14, further comprising transmitting said compressed digital signal through a transmission channel.

16. The method as claimed in claim 15 further comprising providing said plurality of joint-stereo psycho-acoustic parameters to a remote location.

17. The method as claimed in claim 14 further comprising providing an adjustment means whereby a user can adjust at least one of said plurality of joint-stereo psycho-acoustic parameters.

18. The method as claimed in claim 14 further comprising adjusting one of said plurality of joint-stereo psycho-acoustic parameters.

19. The method as claimed in claim 14 wherein at least two of said plurality of joint-stereo psycho-acoustic parameters further comprise a smart group wherein a change in a value of a first one of said at least two joint-stereo psycho-acoustic parameters in said smart group changes a corresponding value of a second one of said at least two joint-stereo psycho-acoustic parameters in said smart group.

20. The method as claimed in claim 19 further comprising adjusting one of said at least two joint-stereo psycho-acoustic parameters in said smart group.

21. The method as claimed in claim 14 wherein said step of decompressing said compressed digital signal to provide an output audio signal is independent of a parametric value of one of said plurality of joint-stereo psycho-acoustic parameters.

22. The method as claimed in claim 21 wherein said step of decompressing said compressed digital signal to provide an output audio signal is independent of a parametric value of each of said plurality of joint-stereo psycho-acoustic parameters.

23. An audio CODEC for providing high quality digital audio comprising:

an input for receiving an audio signal;

an encoder connected to said input, said encoder having a plurality of conventional ISO/MPEG layer-II psycho-acoustic parameters, and a plurality of additional joint-stereo psycho-acoustic parameters, said encoder encoding said audio signal into a compressed digital signal in accordance with said plurality of joint stereo psycho-acoustic parameters along with said conventional ISO/MPEG layer-II psycho-acoustic parameters, each of said joint-stereo psycho-acoustic parameters being selectively programably adjustable by a user for adjusting a compressing of said compressed digital signal;

a decoder for decompressing said compressed digital signal into a digital audio output; and a control for adjusting at least one of said plurality of joint-stereo psycho-acoustic parameters to adjust said audio output.

24. The audio CODEC as claimed in claim 23 wherein at least two of said plurality of joint-stereo psycho-acoustic parameters further comprise a smart group whereby a change in a value of a first one of said at least two joint-stereo psycho-acoustic parameters in said smart group changes a corresponding value of a second one of said at least two joint-stereo psycho-acoustic parameters in said smart group.

25. The audio CODEC as claimed in claim 23 wherein at least one of said plurality of joint-stereo psycho-acoustic parameters has a default value.

26. The audio CODEC as claimed in claim 25 wherein said default value is stored in a memory in said CODEC.

27. The audio CODEC as claimed in claim 23 wherein said control can be adjusted by a user.

28. The audio CODEC as claimed in claim 23 wherein said control can be adjusted by a dynamic psycho-acoustic parameter adjustment.

29. The audio CODEC as claimed in claim 28 wherein said dynamic psycho-acoustic parameter adjustment further comprises a definition of at least one adjustable joint-stereo psycho-acoustic parameter and a corresponding effect of said at least one adjustable joint-stereo psycho-acoustic parameter on a coding and compression scheme of said encoder.

30. The audio CODEC as claimed in claim 28 wherein said control can be adjusted in real time.

31. The audio CODEC as claimed in claim 28 wherein a result of an experimental change in a value of one of said plurality of joint-stereo psycho-acoustic parameter can be heard by a user.

32. The audio CODEC as claimed in claim 23 further comprising an RS232 port whereby said CODEC is connected to a computer by a cable connected to said RS232 port, said computer having values for said joint-stereo psycho-acoustic parameters, said joint-stereo parameter values being transmitted from said computer to said CODEC by said cable.

33. A method for providing high quality digital audio comprising the steps of:

providing a first channel input audio signal;

providing a second channel input audio signal;

providing a plurality of joint-stereo psycho-acoustic parameters, one of said joint-stereo psycho-acoustic parameters being selectively adjustable by a user;

filtering said first channel input audio signal into a first low frequency component and a first high frequency component;

filtering said second channel input audio signal into a second low frequency component and a second high frequency component;

combining said first and second high frequency components into a joint-stereo audio signal;

compressing said joint-stereo audio signal, said first low frequency component, and said second low frequency component into a compressed digital signal;

decompressing said compressed digital signal to provide an output audio signal.

34. The method as claimed in claim 33 further comprising adjusting an audio frequency boundary between said first and second low frequency components and respective corresponding said first and second high frequency components.

35. The method as claimed in claim 34 wherein said audio frequency boundary between said first and second low frequency components and respective corresponding said first and second high frequency components is about 4 KHz.

36. The method as claimed in claim 33 further comprising adjusting a value of one of said joint-stereo psycho-acoustic parameters.

* * * * *

UNITED STATES PATENT AND TRADEMARK OFFICE

CERTIFICATE OF CORRECTION

PATENT NO. : 6,301,555 B2
DATED : October 9, 2001
INVENTOR(S) : Larry W. Hinderks It is certified that error appears in the above-identified patent and that said Letters Patent is hereby corrected as shown below:

Column 16,

Line 65, claim 37 should read -- The audio codec as claimed in claim 3 wherein said default value is stored in a memory in said codec. --

Signed and Sealed this

Eleventh Day of June, 2002

*Attest:*

*Attesting Officer*

JAMES E. ROGAN
*Director of the United States Patent and Trademark Office*